US009676580B2

(12) United States Patent
Baek et al.

(10) Patent No.: US 9,676,580 B2
(45) Date of Patent: Jun. 13, 2017

(54) RECORDING-MEDIUM EJECTING DEVICE AND IMAGE FORMING APPARATUS

(71) Applicant: FUJI XEROX CO., LTD., Tokyo (JP)

(72) Inventors: Seongwoo Baek, Kanagawa (JP); Munseok Yang, Kanagawa (JP); Daesung Kim, Kanagawa (JP); Senggyu Cho, Kanagawa (JP); Youngsea Park, Kanagawa (JP); Minsu Han, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/047,749

(22) Filed: Feb. 19, 2016

(65) Prior Publication Data

US 2017/0001825 A1 Jan. 5, 2017

(30) Foreign Application Priority Data

Jul. 1, 2015 (JP) ..... 2015-132386

(51) Int. Cl.
*B65H 27/00* (2006.01)
*B65H 29/14* (2006.01)

(52) U.S. Cl.
CPC ..... *B65H 27/00* (2013.01); *B65H 29/14* (2013.01); *B65H 2404/1115* (2013.01)

(58) Field of Classification Search
CPC ..... B65H 29/12; B65H 29/125; B65H 29/14; B65H 27/00; B65H 2404/11; B65H 2404/111; B65H 2404/1115; B65H 2404/1121; B65H 2404/131; B65H 2404/1312; B65H 2404/141; B65H 2404/1416
USPC ..... 271/314, 188, 272; 492/27, 30, 33, 34
See application file for complete search history.

(56) References Cited

U.S. PATENT DOCUMENTS 2,471,490 A * 5/1949 Mercer ..... B21D 5/08 72/178
7,200,356 B2 * 4/2007 Kawamoto ..... G03G 15/6576 271/188
7,954,814 B2 * 6/2011 Takahira ..... B65H 5/062 271/272

(Continued)

FOREIGN PATENT DOCUMENTS

JP 05-162868 A 6/1993
JP 2014-061983 A 4/2014

*Primary Examiner* — David H Bollinger
(74) *Attorney, Agent, or Firm* — Sughrue Mion, PLLC

(57) ABSTRACT

A recording-medium ejecting device includes a first rotating member that rotates and a second rotating member that faces the first rotating member and that is rotated by rotation of the first rotating member. At least one of the first rotating member or the second rotating member is provided with projections and recesses at both ends thereof. The projections and recesses are alternately arranged in a circumferential direction. The projections extend continuously from a rotating member body in an axial direction and have a diameter greater than that of the rotating member body. The recesses extend continuously from the rotating member body in the axial direction and have a diameter smaller than that of the rotating member body. The projections at one end of the rotating member body and the projections at the other end of the rotating member body are at the same positions in a circumferential direction.

3 Claims, 8 Drawing Sheets

(56) References Cited

U.S. PATENT DOCUMENTS

| | | | | |
|---|---|---|---|---|
| 8,220,715 | B2 * | 7/2012 | Uehara | B65H 29/14 235/379 |
| 8,646,303 | B2 * | 2/2014 | Welser | B21D 35/006 492/1 |
| 2006/0163803 | A1 * | 7/2006 | Izuchi | B65H 5/062 271/272 |
| 2007/0009308 | A1 * | 1/2007 | Shoji | B41J 3/60 400/625 |
| 2007/0064076 | A1 * | 3/2007 | Carter | B41J 2/0057 347/101 |

* cited by examiner

RECORDING-MEDIUM EJECTING DEVICE AND IMAGE FORMING APPARATUS

CROSS-REFERENCE TO RELATED APPLICATIONS

This application is based on and claims priority under 35 USC 119 from Japanese Patent Application No. 2015-132386 filed Jul. 1, 2015.

BACKGROUND

Technical Field

The present invention relates to a recording-medium ejecting device and an image forming apparatus.

SUMMARY

According to an aspect of the invention, there is provided a recording-medium ejecting device including a first rotating member that rotates; and a second rotating member that faces the first rotating member and that is rotated by rotation of the first rotating member. At least one of the first rotating member or the second rotating member is provided with projections and recesses at both ends thereof. The projections and recesses are alternately arranged in a circumferential direction. The projections extend continuously from a rotating member body, which faces the other rotating member, in an axial direction and have a diameter greater than a diameter of the rotating member body. The recesses extend continuously from the rotating member body in the axial direction and have a diameter smaller than the diameter of the rotating member body. The projections at one end of the rotating member body and the projections at the other end of the rotating member body are at the same positions in a circumferential direction.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described with reference to the drawings.

Figure 1:
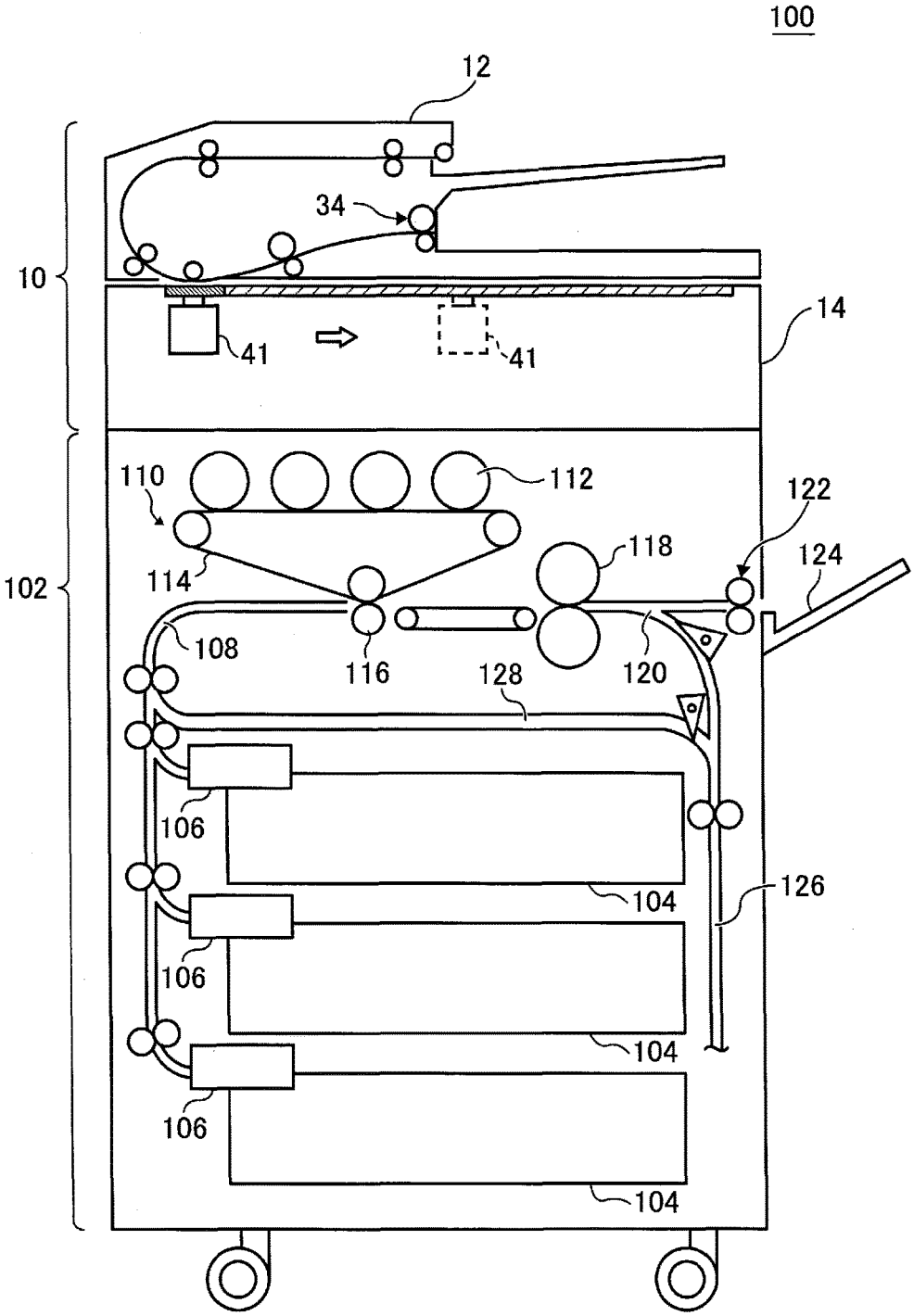
FIG. 1 is a schematic diagram illustrating the structure of an image forming apparatus according to an exemplary embodiment of the present invention.

FIG. 1 is a sectional view of an image forming apparatus 100. The image forming apparatus 100 includes a printing device 102 and an image reading device 10.

The printing device 102 performs printing. The printing device 102 includes, for example, three recording-medium supply cassettes 104, each including a supply head 106.

When one of the recording-medium supply cassettes 104 is selected, the corresponding supply head 106 operates so as to supply a recording medium from the selected recording-medium supply cassette 104 to an image forming unit 110 through a transport path 108.

The image forming unit 110 includes yellow, magenta, cyan, and black photoconductors 112, which are arranged next to each other, and an intermediate transfer belt 114.

A charging device, an exposure device, a developing device, a first transfer device, and a cleaning device, all of which are not shown, are arranged around each photoconductor 112. Toner images are formed on the photoconductors 112 and are transferred onto the intermediate transfer belt 114. When monochrome printing is performed, only devices for forming a black image are activated.

A toner image formed on the intermediate transfer belt 114 is transferred by a second transfer roller 116 onto a recording medium that has been transported, and is fixed by a fixing device 118. The recording medium having the toner image fixed thereto is transported along a transport path 120 and output to a stacking portion 124 through an output mechanism 122.

When duplex printing is performed, the recording medium to which the toner image has been fixed by the fixing device 118 is transported from the transport path 120 to a reversing device 126. The recording medium is reversed by the reversing device 126, transported to a recording-medium reverse transport path 128, and returned to the transport path 108 again. The recording medium is fed to the image forming unit 110, where an image is printed on the back side of the recording medium.

Figure 2:
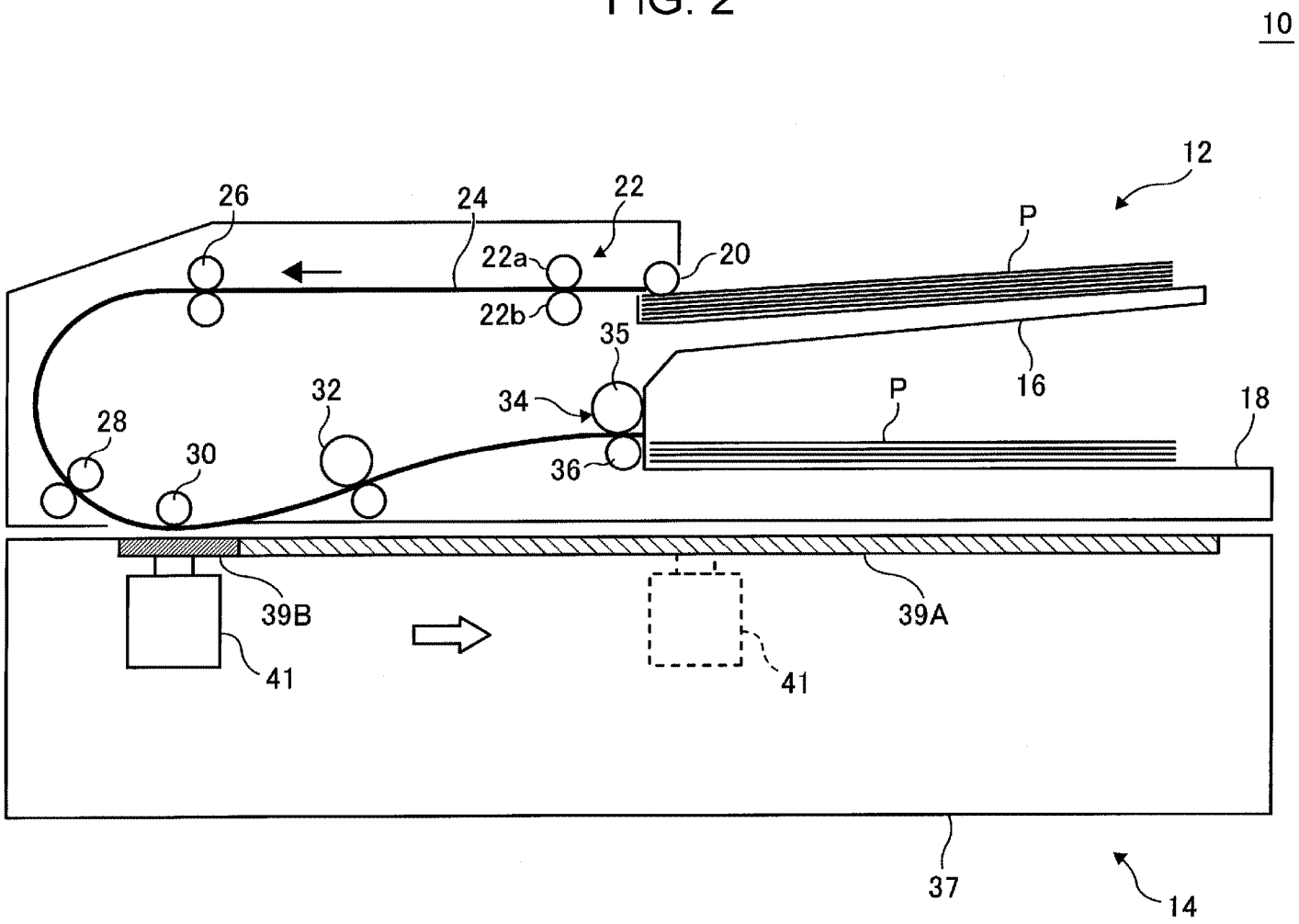
FIG. 2 is a schematic diagram illustrating the structure of an image reading device according to the exemplary embodiment of the present invention.

FIG. 2 illustrates the structure of the image reading device 10 according to the present exemplary embodiment.

The image reading device 10 includes a recording-medium transport device 12 that successively feeds recording media from a stack of recording media and a scanning device 14 that scans each recording medium to read an image formed on the recording medium.

The recording-medium transport device 12 includes a recording-medium receiving portion 16 on which a stack of recording media is placed, and a stacking portion 18 that is disposed below the recording-medium receiving portion 16 and on which the recording media are stacked after the images formed thereon are read. The recording-medium transport device 12 further includes a pick-up roller 20 that feeds the recording media stacked on the recording-medium receiving portion 16. A separation mechanism 22, which separates the recording media from each other, is provided downstream of the pick-up roller 20 in a direction in which the recording media are transported. The separation mechanism 22 includes a feed roller 22*a* that transports the recording media, which have been supplied by the pick-up roller 20, further downstream and a retardation roller 22*b* that separates the recording media, which have been supplied from the pick-up roller 20, from each other. Pre-registration rollers 26, registration rollers 28, a platen roller 30, an out roller 32, and an output mechanism 34, which functions as a recording-medium ejecting device described below, are arranged along a transport path 24 for the recording media in that order from the upstream side in the direction in which the recording media are transported. The pre-registration rollers 26 transport the recording media that have been separated from each other toward downstream rollers, and form a loop of each recording medium. The registration rollers 28 temporarily stop rotating and then restart to rotate at a predetermined timing, thereby supplying each recording medium to an image reading unit, which will be described below, while performing registration adjustment. The platen roller 30 assists transportation of the recording medium while the recording medium is being read by the scanning device 14. The out roller 32 transports the recording medium that has been read by the scanning device 14 further downstream. The output mechanism 34 outputs (ejects) the recording medium that has been read to the stacking portion 18.

The scanning device 14 supports the above-described recording-medium transport device 12 such that the recording-medium transport device 12 may be opened and closed. The recording-medium transport device 12 is placed on a device frame 37. The scanning device 14 reads an image formed on the recording medium transported by the recording-medium transport device 12. The scanning device 14 includes the device frame 37 that serves as a housing, a first platen glass 39A on which the recording medium having the image to be read may be placed in a stationary state, and a second platen glass 39B having an optical opening through which the image on the recording medium transported by the recording-medium transport device 12 is read.

The scanning device 14 also includes a contact image sensor (CIS) 41 that functions as the image reading unit and reads the image while being stationary at a location below the second platen glass 39B or by scanning the entirety of the first platen glass 39A.

Examples of the recording media include sheets of printing paper, such as normal paper and recycled paper, mirror coated paper, color paper, and OHP sheets. In the present exemplary embodiment, the term "recording medium P" is used in the following description.

Figure 3:
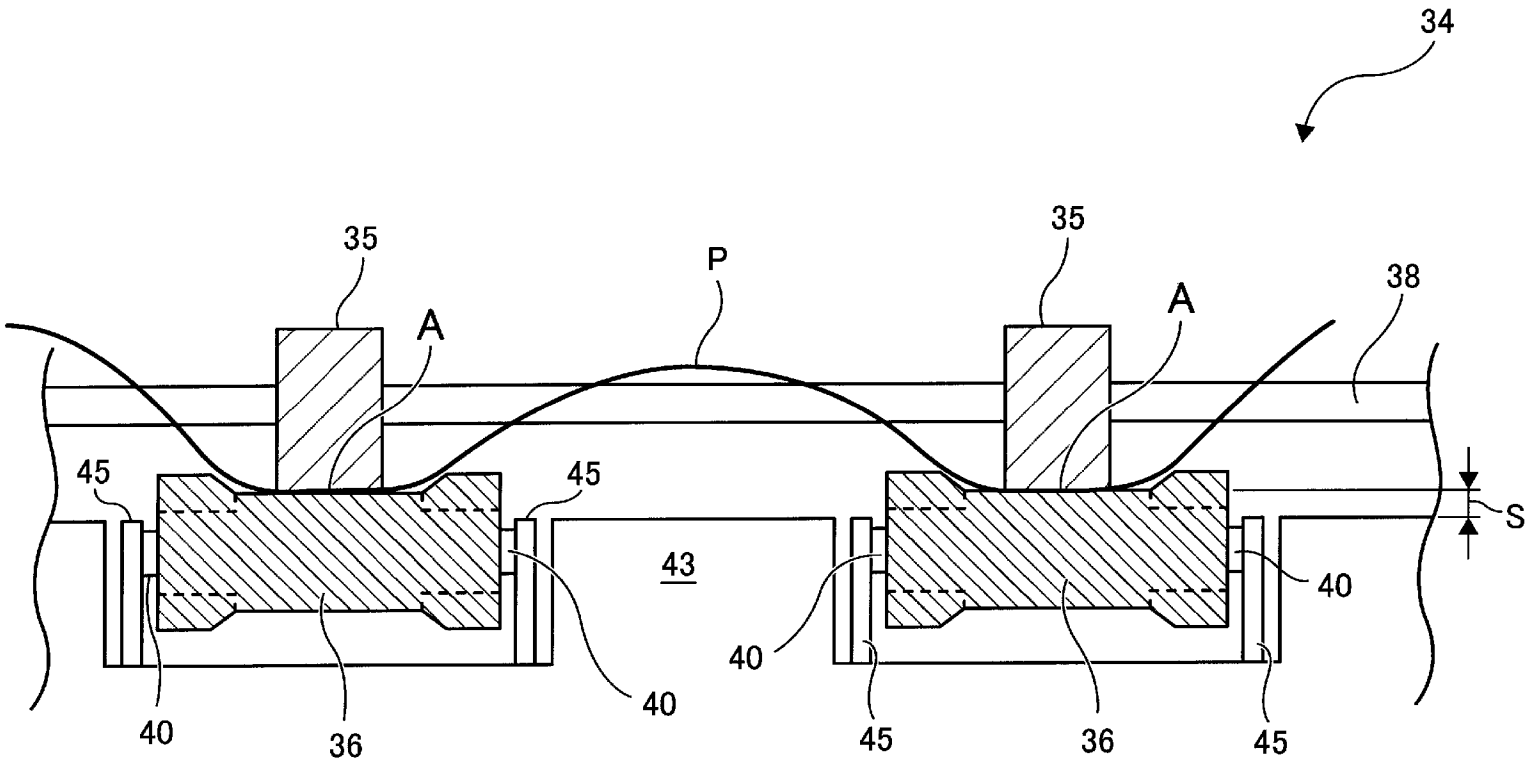
FIG. 3 is a front sectional view of an output mechanism according to the exemplary embodiment of the present invention.

FIG. 3 is a front view of the output mechanism 34.

The output mechanism 34 includes first rotating members 35 that are rotated and second rotating members 36 that face the first rotating members 35 and that are rotated by the rotation of the first rotating members 35.

The first rotating members 35 are covered with a material having a high coefficient of friction, such as a rubber material, and are supported by a support shaft 38 at the center thereof. The support shaft 38 is connected to a drive source (not shown).

The second rotating members 36 are made of, for example, a plastic material, and are each supported by a support shaft 40 at the center thereof. The support shaft 40 is supported by bearings 45.

More specifically, the second rotating members 36 are in contact with and pressed against the first rotating members 35, and are rotated by the rotation of the first rotating members 35 so as to output the recording medium P toward the stacking portion 18.

The space between the second rotating members 36 is covered with a frame 43 so that a foreign body or a finger does not enter the space.

The frame 43 is located below contact surfaces A between the first rotating members 35 and the second rotating members 36 by a distance S in the direction of gravity. The recording medium P is ejected toward the stacking portion 18 after passing through the space between the first rotating members 35 and the second rotating members 36.

Figure 4A:
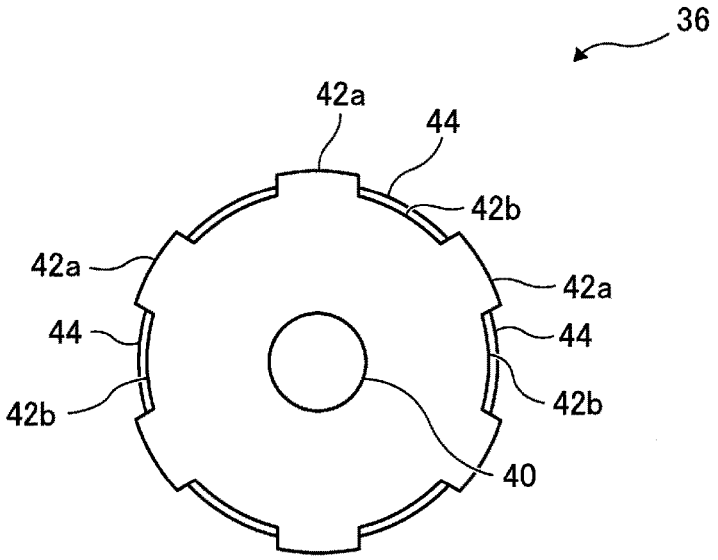
FIGS. 4A and 4B are a side view and a front view, respectively, of a second rotating member according to the exemplary embodiment of the present invention.
Figure 4B:
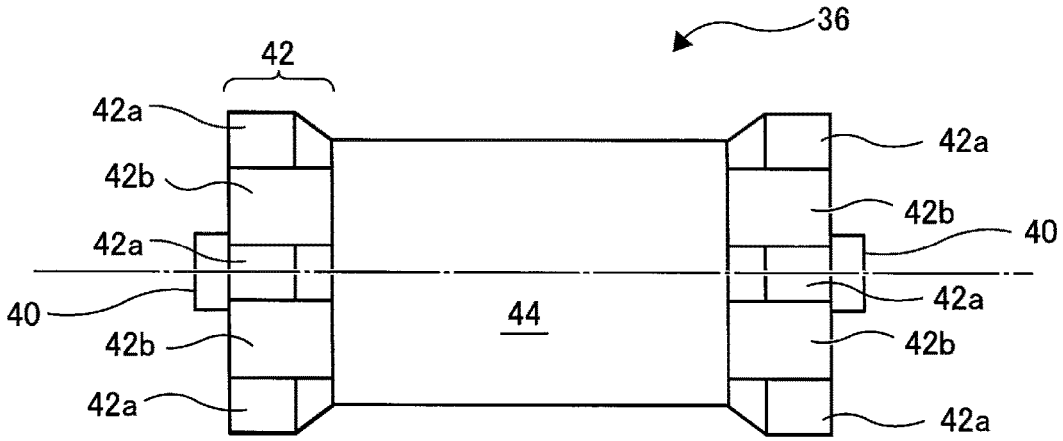

FIGS. 4A and 4B are a side view and a front view, respectively, of each second rotating member 36.

The second rotating member 36 includes a rotating member body 44 that faces the corresponding first rotating member 35; projections 42*a* that extend continuously from the rotating member body 44 in an axial direction and have a diameter greater than that of the rotating member body 44; and recesses 42*b* that extend continuously from the rotating member body 44 in the axial direction and have a diameter smaller than that of the rotating member body 44.

The projections 42*a* and the recesses 42*b* are alternately arranged at constant intervals over the circumference of the rotating member body 44.

The projections 42*a* and the recesses 42*b* are provided at both ends of the rotating member body 44.

The projections 42*a* are tapered or curved so as to be smoothly connected to the rotating member body 44.

The recesses 42*b* are tapered or curved so as to be smoothly connected to the rotating member body 44.

In the second rotating member 36, the projections 42*a* at one end of the rotating member body 44 and the projections 42*a* at the other end of the rotating member body 44 are at the same positions in the circumferential direction. Similarly, the recesses 42*b* at one end of the rotating member body 44 and the recesses 42*b* at the other end of the rotating member body 44 are at the same positions in the circumferential direction.

The operation of the output mechanism 34 according to the exemplary embodiment of the present invention will now be described.

Figure 5A:
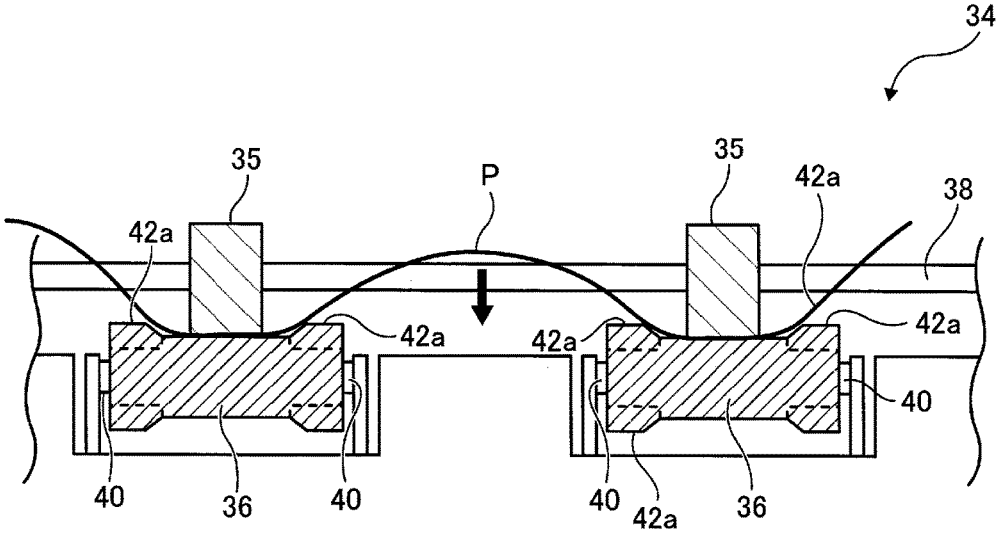
FIGS. 5A and 5B are front sectional views illustrating the operation of the output mechanism according to the exemplary embodiment of the present invention.
Figure 5B:
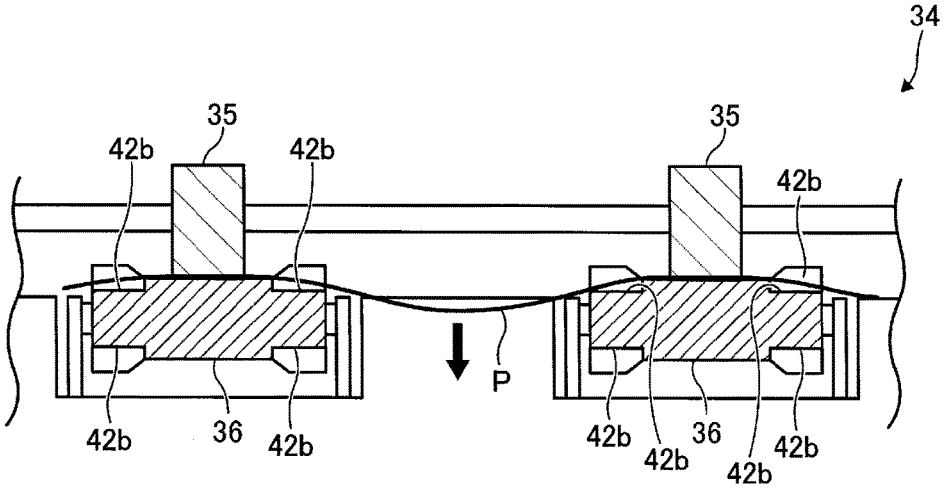

FIGS. 5A and 5B are front sectional views illustrating the operation of the output mechanism 34.

Figure 6A:
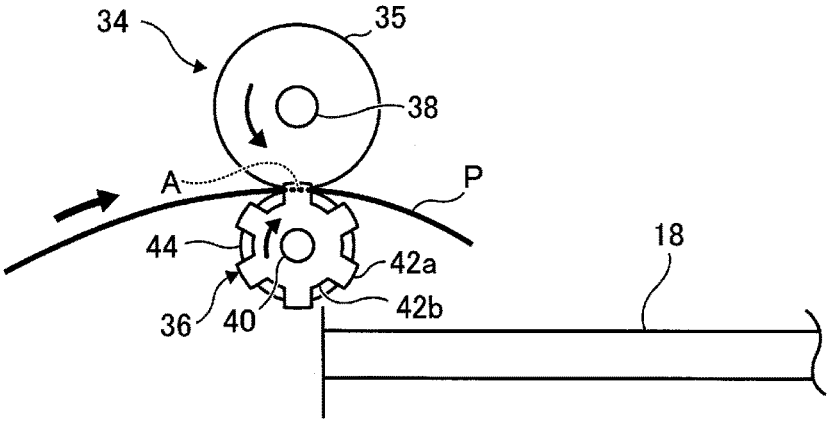
FIGS. 6A to 6C illustrate how the recording medium is output from the output mechanism according to the exemplary embodiment of the present invention.
Figure 6B:
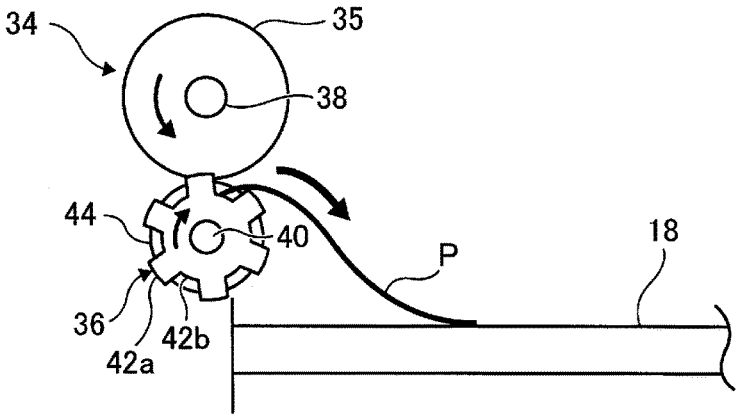
Figure 6C:
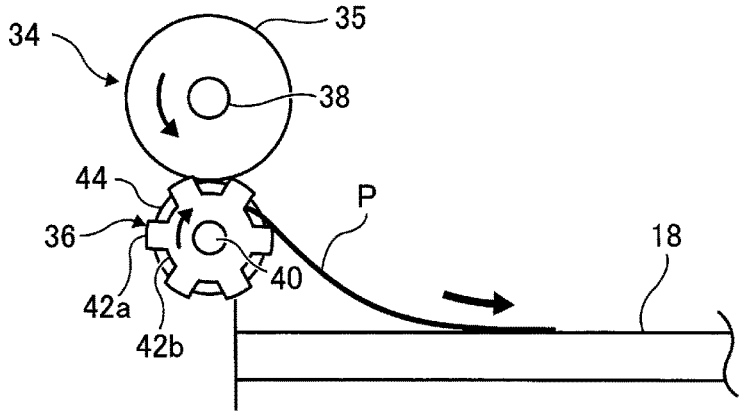

FIGS. 6A to 6C illustrate how the recording medium P is output from the output mechanism 34.

When the projections 42*a* face the transport surface of the recording medium P, the recording medium P is pushed upward at both ends of each first rotating member 35, and is transported while being deformed in accordance with the stiffness thereof (see FIG. 5A).

When the recesses 42*b* face the transport surface of the recording medium P, the recording medium P is moved downward at both ends of each first rotating member 35, and is transported while being deformed in a wavy shape different from that in FIG. 5A (see FIG. 5B).

When the first rotating members 35 and the second rotating members 36 rotate, the projections 42*a* at one and the other ends in the axial direction simultaneously come into contact with the recording medium P, and the recesses 42*b* at one and the other ends in the axial direction simultaneously come into contact with the recording medium P. Accordingly, when the first rotating members 35 and the second rotating members 36 rotate, the recording medium P is transported toward the stacking portion 18 while the shape thereof is changed (see FIG. 6A).

When the trailing end of the recording medium P leaves the contact surfaces A between the first rotating members 35 and the second rotating members 36, the trailing end of the recording medium P remains in the recesses 42*b* in the second rotating members 36 (see FIG. 6B).

Then, the trailing end of the recording medium P is pushed by side surfaces of the projections 42*a* in the recesses 42*b*, so that the recording medium P is pushed out and falls onto the stacking portion 18 (see FIG. 6C).

Thus, the occurrence of ejection failure of the recording medium is reduced even when the recording medium is a sheet of recycled paper or has a small basis weight and is output at a low speed. The occurrence of ejection failure of the recording medium is also reduced even in an environment where the temperature and humidity are high.

Figure 7A:
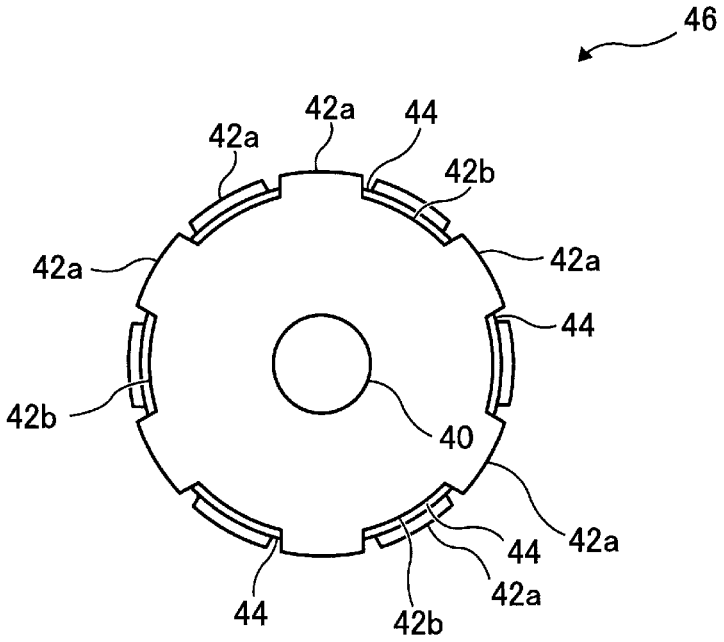
FIGS. 7A and 7B are a side view and a front view, respectively, of a second rotating member according to another exemplary embodiment of the present invention.
Figure 7B:
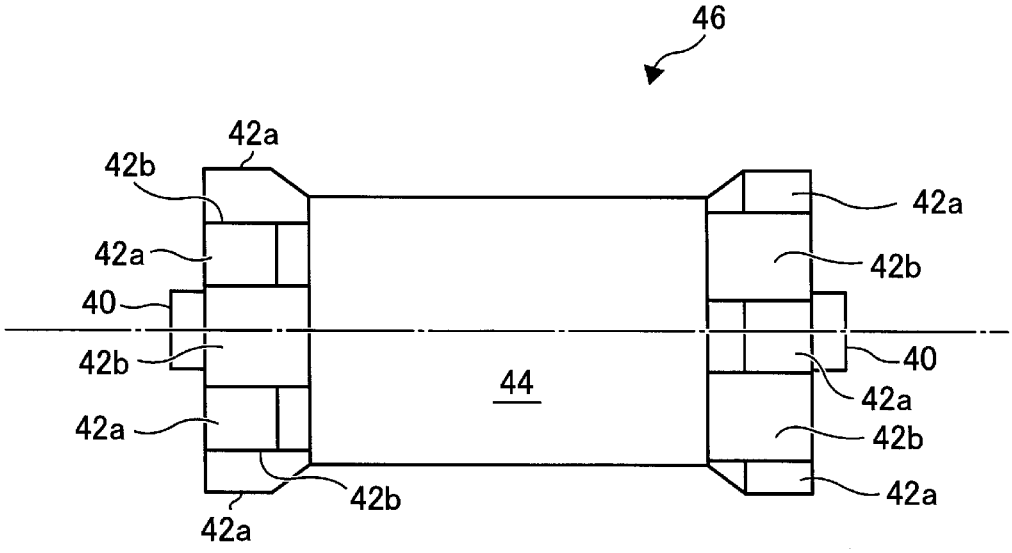

FIGS. 7A and 7B are a side view and a front view, respectively, of each second rotating member 46 according to another exemplary embodiment of the present invention.

In the present exemplary embodiment, the arrangement of projections 42*a* and recesses 42*b* at one end of the second rotating member 46 differs from that at the other end.

In the second rotating member 46, the projections 42*a* at one end of a rotating member body 44 and the projections 42*a* at the other end of the rotating member body 44 are at different positions in the circumferential direction. Similarly, the recesses 42*b* at one end of the rotating member body 44 and the recesses 42*b* at the other end of the rotating member body 44 are at different positions in the circumferential direction. More specifically, the projections 42*a* and the recesses 42*b* at one and the other ends are arranged in a staggered pattern.

Figure 8A:
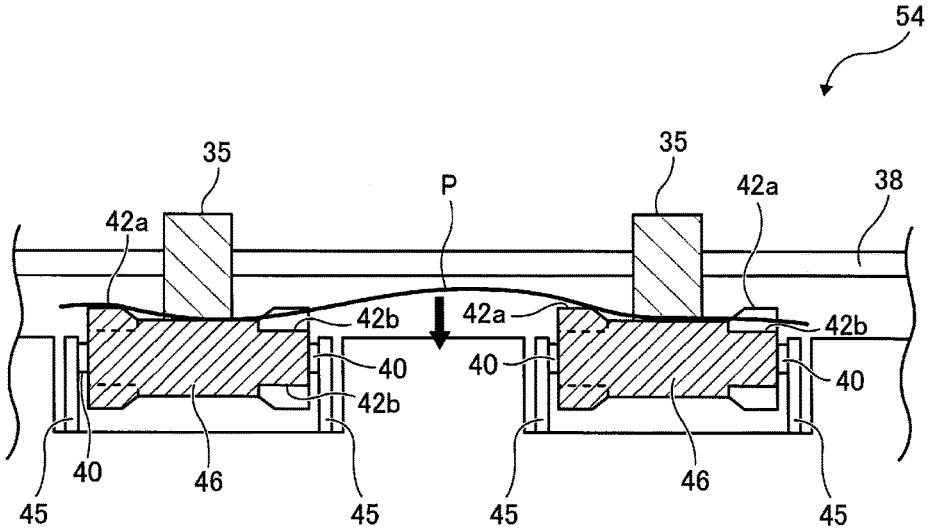
FIGS. 8A and 8B are front sectional views illustrating the operation of the output mechanism according to the other exemplary embodiment of the present invention.
Figure 8B:
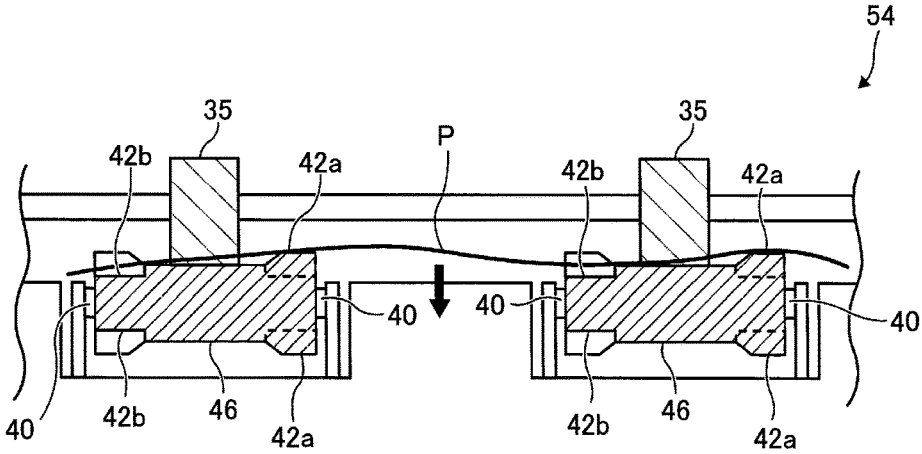

FIGS. 8A and 8B are front sectional views illustrating the operation of an output mechanism 54 including the second rotating members 46.

In the present exemplary embodiment, when one of the projections 42*a* faces the transport surface of the recording medium P at one end of each second rotating member 46, one of the recesses 42*b* faces the transport surface of the recording medium P at the other end of the second rotating member 46.

Accordingly, the recording medium P is pushed upward at one end of each first rotating member 35 and moved downward at the other end, and is transported while being deformed in accordance with the stiffness thereof (see FIG. 8A).

When one of the recesses 42*b* faces the transport surface of the recording medium P at one end of each second rotating member 46, one of the projections 42*a* faces the transport surface of the recording medium P at the other end of the second rotating member 46. Accordingly, the recording medium P is moved downward at one end of each first rotating member 35 and pushed upward at the other end, and is transported while being deformed in a shape different from that in FIG. 8A (see FIG. 8B).

Thus, when the first rotating members 35 and the second rotating members 46 rotate, one of the projections 42*a* at one end and one of the recesses 42*b* at the other end simultaneously come into contact with the recording medium P. Accordingly, when the first rotating members 35 and the second rotating members 46 rotate, the projections 42*a* and the recesses 42*b* alternately come into contact with the recording medium P at one and the other ends, and the recording medium P is transported toward the stacking portion 18 while the shape thereof is changed. Then, the trailing end of the recording medium P remains in the recesses 42*b* in the second rotating members 46, and is pushed by side surfaces of the projections 42*a* of the second rotating members 46, so that the recording medium P is pushed out and falls onto the stacking portion 18.

In the first exemplary embodiment, the projections 42*a* or the recesses 42*b* simultaneously come into contact with the recording medium P at both ends of each first rotating member 35. In the present exemplary embodiment, the projections 42*a* and the recesses 42*b* alternately come into contact with the recording medium P at one and the other ends of each first rotating member 35. Accordingly, the trailing end of the recording medium P more easily remains in the recesses 42*b* and more easily comes into contact with, or pushed out by, the side surfaces of the projections 42*a* than in the above-described first exemplary embodiment. Thus, the number of times the trailing end of the recording medium P comes into contact with, or pushed out by, the side surfaces of the projections 42*a* is increased.

Although two pairs of rotating members are provided in the above-described exemplary embodiments, the number of rotating members is not limited to this.

In addition, although the recesses and projections are provided on the second rotating members 36 and 46 at both ends thereof in the above-described exemplary embodiments, the recesses and projections may instead be provided on the first rotating members 35 at both ends thereof.

In addition, although the recesses and projections are provided on the second rotating members 36 and 46 at both ends thereof in the above-described exemplary embodiments, the recesses and projections may instead be provided only at one end of each second rotating member.

In addition, although the second rotating members 36 and 46 that are rotated are individually supported by the support shafts 40 and the bearings 45 in the above-described exemplary embodiments, the second rotating members may instead be supported by a single support shaft.

In addition, although the present invention is applied to the output mechanism 34 of the recording-medium transport device 12 in the above-described exemplary embodiments, the present invention may also be applied to the output mechanism 122 of the printing device 102.

As described above, the present invention may be applied to imaging forming apparatuses such as copy machines, printers, scanners, and facsimile devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-medium ejecting device comprising:

a first rotating member configured to rotate; and a second rotating member that faces the first rotating member and that is configured to be rotated by rotation of the first rotating member, wherein at least one of the first rotating member or the second rotating member is provided with projections and recesses at both ends thereof, wherein the projections and recesses are alternately arranged in a circumferential direction, wherein the projections extend continuously from a rotating member body of the at least one of the first rotating member or the second rotating member, in an axial direction, wherein the rotating member body faces another of the first rotating member and the second rotating member, wherein the projections have a diameter greater than a diameter of the rotating member body, wherein the recesses extend continuously from the rotating member body in the axial direction and have a diameter smaller than the diameter of the rotating member body, and wherein the projections at one end of the rotating member body and the projections at the other end of the rotating member body are at same positions in a circumferential direction.

2. A recording-medium ejecting device comprising:

a first rotating member configured to rotate; and a second rotating member that faces the first rotating member and that is configured to be rotated by rotation of the first rotating member, wherein at least one of the first rotating member or the second rotating member is provided with projections and recesses at both ends thereof, wherein the projections and recesses are alternately arranged in a circumferential direction, wherein the projections extend continuously from a rotating member body of the at least one of the first rotating member or the second rotating member, in an axial direction, wherein the rotating member body faces another of the first rotating member and the second rotating member, wherein the projections have a diameter greater than a diameter of the rotating member body, wherein the recesses extend continuously from the rotating member body in the axial direction and have a diameter smaller than the diameter of the rotating member body, and wherein the projections at one end of the rotating member body and the projections at the other end of the rotating member body are at different positions in a circumferential direction.

3. An image forming apparatus comprising:

an image forming unit configured to form an image on a recording medium;

a transport path configured to transport the recording medium having the image formed thereon by the image forming;

a recording-medium ejecting device provided at a downstream end of the transport path in a direction in which the recording medium is transported; and a stacking portion configured to stack the recording medium ejected by the recording-medium ejecting device, wherein the recording-medium ejecting device includes:

a first rotating member configured to rotate, and a second rotating member that faces the first rotating member and that is configured to be rotated by rotation of the first rotating member, wherein at least one of the first rotating member or the second rotating member is provided with projections and recesses at both ends thereof, wherein the projections and recesses are alternately arranged in a circumferential direction, wherein the projections extend continuously from a rotating member body of the at least one of the first rotating member or the second rotating member, in an axial direction, wherein the rotating member body faces another of the first rotating member and the second rotating member, wherein the projections have a diameter greater than a diameter of the rotating member body, and wherein the recesses extend continuously from the rotating member body in the axial direction and have a diameter smaller than the diameter of the rotating member body.

* * * * *